US006767422B1

(12) United States Patent
Atsumi et al.

(10) Patent No.: US 6,767,422 B1
(45) Date of Patent: Jul. 27, 2004

(54) SHAFT FOR LIGHT-WEIGHT GOLF CLUBS

(75) Inventors: Tetsuya Atsumi, Toyohashi (JP); Ikuo Takiguchi, Toyohashi (JP); Tsutomu Ibuki, Toyohashi (JP); Katsumi Anai, Tokyo (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 09/473,495

(22) Filed: Dec. 28, 1999

Related U.S. Application Data

(62) Division of application No. 09/193,928, filed on Nov. 17, 1998.

(30) Foreign Application Priority Data

Nov. 17, 1997 (JP) ..... 9-314867
Apr. 10, 1998 (JP) ..... 10-099066

(51) Int. Cl.[7] ..... A63B 53/10; B65H 81/00

(52) U.S. Cl. ..... 156/184; 156/188; 428/35.7; 428/36.1; 473/316; 473/319

(58) Field of Search ..... 264/45.3, 314, 264/512, 516; 473/319–320, 289; 428/35.9, 36.3, 36.91; 156/188–193

(56) References Cited

U.S. PATENT DOCUMENTS 3,646,610 A * 2/1972 Jackson ..... 273/80 R
4,000,896 A * 1/1977 Lauraitis ..... 473/319
4,023,801 A * 5/1977 VanAuken ..... 473/319
5,156,396 A * 10/1992 Akatsuka et al. ..... 473/319
5,231,783 A * 8/1993 Utsuno ..... 43/18.5
5,685,783 A * 11/1997 Akatsuka et al. ..... 473/319
5,720,671 A * 2/1998 Cheng ..... 473/305
5,984,804 A * 11/1999 Berg ..... 473/319
6,106,413 A * 8/2000 Kusumoto ..... 473/319

FOREIGN PATENT DOCUMENTS

| | | |
|---|---|---|
| JP | 04-92270 | 8/1992 |
| JP | 08131588 | * 5/1996 |
| JP | 09140839 | * 6/1997 |
| JP | 09266966 | * 11/1997 |
| JP | 409327536 | * 12/1997 |

* cited by examiner

*Primary Examiner*—Jeff H. Aftergut
*Assistant Examiner*—Justin Fischer
(74) *Attorney, Agent, or Firm*—Darby & Darby

(57) ABSTRACT

A golf club shaft is 35–50 percent lighter than a conventional shaft while maintaining the outer diameter and structural characteristics of conventional shafts. The shaft has at least four layers of fiber reinforced material. The fiber reinforced layers are from innermost to outermost: a first angled layer; a first straight layer; a second angled layer; and a second straight layer. The angled layers are formed by bonding together two materials, each with fibers aligned in different directions. The second angled layer maintains the proper strength and rigidity of the shaft while keeping the shaft as light weight as possible. Aligning the second layer's fibers at an angle of 35–75 degrees with respect to the longitudinal direction of the shaft ensures proper weight and strength characteristics of the shaft. The resulting shaft is light-weight and exhibits the flexural rigidity, flexural strength, torsional rigidity, torsional strength, and crushing strength of conventional shafts.

3 Claims, 4 Drawing Sheets

SHAFT FOR LIGHT-WEIGHT GOLF CLUBS

BACKGROUND OF THE INVENTION

This application is a division of pending application Ser. No. 09/193,928, filed Nov. 17, 1998.

The present invention relates to a shaft for golf clubs (hereinafter referred to simply as shaft). More specifically, the present invention relates to a shaft that is 35–50 percent lighter than conventional shafts while providing the same outer diameter and the same characteristics as conventional shafts such as flexural rigidity, flexural strength, torsional rigidity, torsional strength, and crushing strength.

In one type of golf club, a fiber-reinforced composite material (hereinafter referred to as FRP) is used in forming the shaft. In this type of shaft, a fiber-reinforced fiber material is formed by lining up reinforcing fibers in a "one-directional" pre-impregnation (hereinafter referred to as prepregs) and then immersing the aligned fiber material in a resin. The shaft is then formed by wrapping the fiber-reinforced material around a tapered metal mandrel and hardening the composite in a laminated state. This type of golf club shaft is widely used due to its high specific rigidity, specific strength, and the degree of freedom allowed in its design.

FRP shafts often use a two-layer structure to form the reinforced composite. An inner layer is formed of angled fibers (angled layer) and an outer layer is formed from straight fibers (straight layer). In the angled layer, prepregs are glued together so that the reinforcing fibers form angles of +theta; −theta relative to the longitudinal axis of the shaft. In the straight layer, the prepregs are stacked so that the reinforcing fibers are within a +/−20 degree range relative to the longitudinal axis of the shaft.

In recent years, there has been a trend toward creating lighter golf club shafts. By lightening the shaft it is possible to produce a larger "sweet spot" in the golf club head. With a larger "sweet spot" in the golf club head, golf clubs can be designed to accompany higher head speeds, longer shafts, and larger heads.

Conventionally, lighter golf club shafts are designed and manufactured by simply reducing the number of straight layers and angled layers that make up the shaft. As a consequence of reducing the number of layers there is a reduction in flexural rigidity, flexural strength, torsional rigidity, torsional strength, and crushing strength. These reductions in strength and rigidity are undesirable.

Alternative methods have been attempted to create lighter shafts which minimize the adverse effects on strength and rigidity. Two methods which provide for a lighter shaft while maintaining flexural rigidity and torsional rigidity are as follows:

(1) reduce the number of straight layers and/or angled layers while also using a reinforcing fiber that has a high elasticity in these layers; and (2) reduce the thickness of the layers by changing the shape of the shaft itself, primarily by increasing the outer diameter.

In method (1), the flexural rigidity and torsional rigidity are comparable with conventional shafts. However, reinforcing fibers with high elasticity generally have low strength. Golf club shafts designed according to method (1) result in flexural and torsional strengths which are the same as, or even lower than, golf clubs shafts which simply have the number of layers reduced.

In method (2), increasing the outer diameter near the grip is effective in maintaining flexural rigidity. However, the increased grip diameter results in a golf club shaft that is difficult to handle, making the arrangement impractical.

Japanese laid-open utility model publication number 62-33872 discloses a method for improving the torsional rigidity and torsional strength in FRP shafts. According to this method, an FRP shaft includes angled layers and straight layers which are formed with the angled layer as the outermost layer. However, the finishing process of the FRP shaft, i.e., polishing and the like, can result in a loss in the angled layer. The thickness of the angled layer is needed to maintain torsional rigidity and torsional strength. Thus, FRP shafts made according to this method do not have consistent quality. In addition, this method does not provide for a lighter FRP shaft.

Japanese laid-open patent publication number 8-131588 provides for another method of improving an FRP shaft. According to this method, an FRP shaft includes (starting from the inner most layer): a thin hoop layer, a straight layer, and an angled layer. As in the method previously described above, the finishing process of the FRP shaft, i.e., polishing and the like, can result in the loss of the angled layer needed to maintain torsional rigidity and torsional strength. Thus, FRP shafts made according to this method do not have consistent quality and do not result in a lighter FRP shaft.

OBJECTS AND SUMMARY OF THE INVENTION

It is an object of the present invention to provide a golf club shaft which overcomes the drawbacks in the prior art.

It is another object of the present invention to provide a lighter golf club shaft that overcomes the drawbacks of the prior art.

It is yet another object of the present invention to overcome the problems of the prior art and to provide a shaft that is 35–50% lighter than a conventional shaft.

It is a further object of the present invention to overcome the problems of the prior art and to provide a shaft that is 35–50% lighter than a conventional shaft while maintaining the same outer diameter as a conventional shaft.

It is another object of the present invention to overcome the problems of the prior art and to provide a shaft that is 35–50% lighter than a conventional shaft while maintaining the flexural rigidity, flexural strength, torsional rigidity, and torsional strength of a conventional shaft.

It is yet another object of the present invention to overcome the problems of the prior art and to provide a shaft that is 35–50% lighter than a conventional shaft while maintaining the outer diameter, flexural rigidity, flexural strength, torsional rigidity, and torsional strength of a conventional shaft.

It is another object of the present invention to provide a light-weight golf club shaft that is formed by laminating a plurality of fiber-reinforced composite materials. The laminate is made by forming the following layers in sequence starting with the inner most layer: a first angled layer; a first straight layer; a second angled layer; and a second straight layer. Each layer is a fiber-reinforced composite material. The laminated layers extend over the entire length of the shaft.

It is another object of the present invention to provide a light-weight golf club shaft formed by laminating a plurality of fiber-reinforced composite materials, the laminate being made by forming a first angled layer, a first straight layer formed on the first angled layer; a second angled layer formed on the first straight layer, and a second straight layer formed on the second angled layer. Each layer is a fiber-reinforced composite material. The laminated layers extend over the entire length of the shaft. The second angled layer has a thickness of 0.04–0.10 mm, and reinforcing fibers contained therein have an orientation of 35–75 degrees relative to the longitudinal direction of the shaft. The shaft has a torsional strength of at least 120 kgf×m×degrees (1200 N×m×degrees) and a weight of 30–40 g.

Briefly stated, the present invention provides a golf club shaft that is 35–50 percent lighter than a conventional shaft while maintaining the outer diameter and structural characteristics of conventional shafts. The shaft has at least four layers of fiber reinforced material. The fiber reinforced layers are from innermost to outermost: a first angled layer; a first straight layer; a second angled layer, and a second straight layer. The angled layers are formed by bonding together two materials, each with fibers aligned in different directions. The second angled layer maintains the proper strength and rigidity of the shaft while keeping the shaft as light weight as possible. Aligning the second layer's fibers at an angle of 35–75 degrees with respect to the longitudinal direction of the shaft ensures proper weight and strength characteristics of the shaft. The resulting shaft is light-weight and exhibits the flexural rigidity, flexural strength, torsional rigidity, torsional strength, and crushing strength of conventional shafts.

According to an embodiment of the present invention, there is provided a light-weight golf club shaft comprising: a first angled layer, a first straight layer formed on said first angled layer, a second angled layer formed on said first straight layer, a second straight layer formed on said second angled layer, said shaft having a length along a longitudinal direction, each of said layers extend over said length of said shaft and includes fiber-reinforced composite material, said fiber-reinforced composite material containing reinforcing fibers, said reinforcing fibers of said second angled layer being oriented at an angle relative to said longitudinal direction of said shaft, and said second angled layer being selected to provide said shaft with a torsional strength of at least 120 kgf×m×degrees and a weight of from 30 to 40 g.

According to another embodiment of the present invention, there is provided a light-weight golf club shaft, said shaft having a length along a longitudinal direction, comprising: a first angled layer, a first straight layer formed on said first angled layer, a second angled layer formed on said first straight layer, a second straight layer formed on said second angled layer, each of said layers extend over said length of said shaft and include fiber-reinforced composite material, said fiber-reinforced composite material containing reinforcing fibers, said reinforcing fibers of said second angled layer oriented at an angle in a range of from 35 to 75 degrees relative to said longitudinal direction of said shaft, said second angled layer has a thickness in a range of from 0.04 to 0.1 mm, said shaft has a small-diameter end and a large-diameter end, said first angled layer has a first thickness near said small-diameter end of said shaft, said first angled layer has a second thickness near said large-diameter end of said shaft, said first thickness is substantially twice said second thickness, and said layers are effective to provide said shaft with a torsional strength of at least 120 kgf×m×degrees and a weight of from 30–40 g.

According to a method of the present invention, there is provided a method forming a golf club shaft around a mandrel having a length along a longitudinal axis, the steps comprising: forming a first reinforcement layer from a first fiber material, said first fiber material having fibers aligned along a single direction, forming a first angled layer from second and third fiber material, said second and third materials having fibers aligned along a single direction, bonding said second and third materials together to form said first angled layer, such that said fibers of said second material form a first angle with said fibers of said third material, forming a first straight layer from a fourth fiber material, said fourth fiber material having fibers aligned along a single direction, forming a second angled layer from fifth and sixth fiber material, said fifth and sixth materials having fibers aligned along a single direction, bonding said fifth and sixth fiber materials together to form said second angled layer, such that said fibers of said fifth and sixth material form a second angle in the range of from 70–150 degrees and said second angled layer has a thickness in the range of from 0.04 to 0.1 mm, forming a second straight layer from a seventh fiber material, said seventh fiber material having fibers aligned along a single direction, forming a second reinforcement layer from an eighth fiber material, said fiber material having fibers aligned along a single direction, wrapping said first reinforcement layer around said mandrel such that said fibers of said first reinforcement layer are aligned 90 degrees with respect to said longitudinal axis, wrapping said first angled layer around said first reinforcement layer such that said first angle of said fiber material of said first angled layer is bisected by said longitudinal axis, wrapping said first straight layer around said first angled layer such that said fibers of said first straight layer are aligned with said longitudinal axis, wrapping said second angled layer around said first straight layer such that said second angle of said fiber material of said second angled layer is bisected by said longitudinal axis, wrapping said second straight layer around said second angled layer such that said fibers of said second straight layer are aligned with said longitudinal axis, wrapping second reinforcement layer around said second straight layer to form a layered wrap, such that said fibers of said second reinforcement layer are aligned with said longitudinal axis, curing said layered wrap in an oven to form a cured shaft, removing said mandrel from said cured shaft, and trimming ends said cured shaft to produce said golf club shaft.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*b*) shows a cross sectional view of overlaid fiber layers around a mandrel as used in the present invention.

DETAILED DESCRIPTION OF THE PREFERRED EMBODIMENTS

There are no special restrictions on the reinforcing fiber used in the FRP of the light-weight shaft of the present invention. Any standard FRP reinforcing fiber can be used in the present invention. The reinforcing fibers include organic, inorganic and metal reinforcing fibers. Examples of reinforcing fibers include: high-strength polyethylene, para-aromatic polyamides, carbon fibers, glass fibers, boron fibers, silicon carbide fibers, alumina fibers, and Tyranno fibers. In the present invention, the reinforcing fibers do not necessarily need to be partially or entirely comprised of high-elasticity reinforcing fibers as described in the conventional technology.

There are no special restrictions on the matrix resin used in the FRP for the light-weight shaft of the present invention. Any standard FRP matrix resin can be used in the present invention. Generally, thermosetting matrix resins are used. Examples of such resins include: epoxy resins, unsaturated polyester resins, vinyl ester resins, polyimide resins, and polybismaleimide resins. Thermoplastic resins can be used for the matrix resin without changing the essence of the present invention.

The fiber-reinforced composite material used in the shaft is generally formed with a "prepreg" (pre-impregnated material). A prepreg is formed by aligning one of the above described reinforcing fibers along a single direction and immersing the aligned fiber in the matrix resin. The fiber-reinforced composite material has no special restrictions on the thickness, fabric weight, resin content and the like. These factors can be chosen according to the required thickness and wrapping diameters of the layers.

Figure 1B:
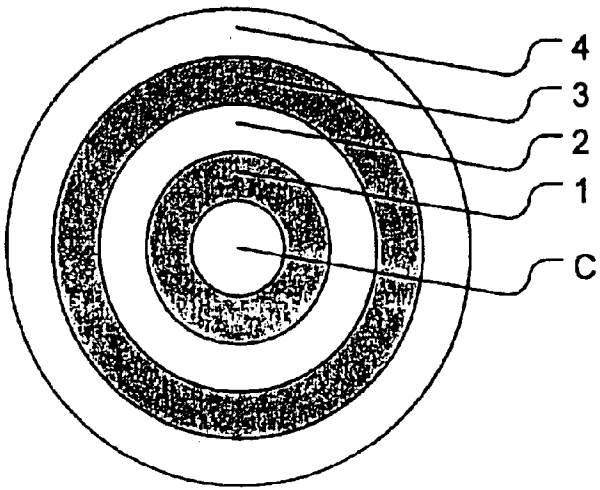
FIG. 1(*a*) shows overlaid fiber layers according to the present invention.
Figure 1A:
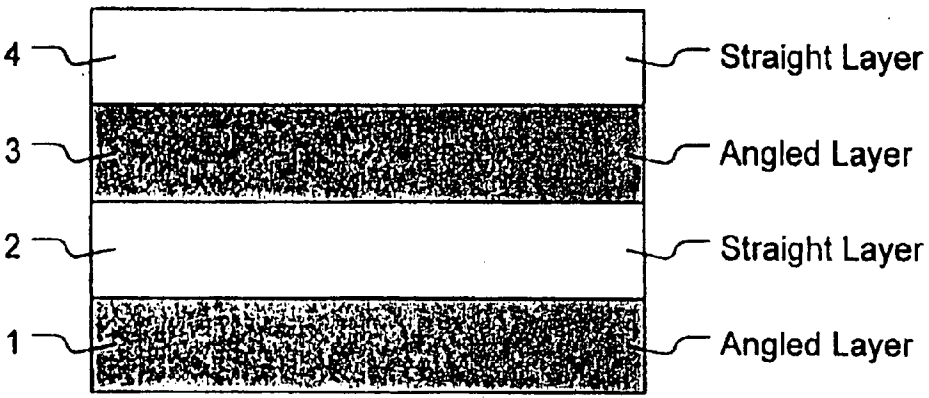

Referring to FIGS 1(*a*)–(*b*), a light-weight shaft according to the present invention has a main structure containing four layers. Starting with the innermost layer, there is: a first angled layer (1), a first straight layer (2), a second angled layer (3), and a second straight layer (4). As shown in FIG. 1(*b*), the four layers (1–4) are formed concentrically around a mandrel (C). The mandrel (C) is only used during manufacturing. After manufacturing, the mandrel (C) is removed.

The design of the second angled layer (3) is critical to reducing the weight of the shaft while maintaining various shaft characteristics. Examples of the shaft characteristics are the outer diameter and maintaining balance for a high torsional strength. To achieve the required weight and shaft characteristics, the second angled layer (3) should have a thickness in the range of 0.04–0.11 mm. The reinforcing fibers used in the second angled layer should be oriented at 35–75 degrees relative to the longitudinal axis (L) of the shaft. Where a high crushing strength is desired, it is preferred that the orientation angle be in the range of 60–75 degrees. A most preferred embodiment uses an orientation angle of 65–70 degrees.

Additional layers can be added to the basic four layer structure discussed above. According to the invention, any number of layers can be added as long as the overall diameter and weight are in accordance with the invention. By adding the additional layers, the end of the shaft can be reinforced, diameters can be matched, rigidity and strength can be enhanced and the like.

There are no special restrictions on the thickness of the first angled layer (1) as long as the thickness is a standard value generally used in FRP shafts. In a preferred embodiment, a thickness in the range of from 0.2–0.4 mm is desirable to prevent longitudinal cracking of the material, which can occur in the shaft with the removal of metal mandrel (C), which serves as a mold during manufacture.

The thickness of the first angled layer (1) does not have to be uniform over the entire length of the shaft. For example, it is possible to have the thickness of the first angled layer at the small-diameter end of the shaft equal to twice the thickness of the large-diameter end of the shaft. The thickness of the layer can be used to improve various other characteristics of the shaft while preserving the objects of the invention, i.e., the flexural rigidity, flexural strength, torsional rigidity, torsional strength, and crushing strength.

The first straight layer (2) and the second straight layer (4) do not have any special restrictions on their thickness as long as their total thickness is comparable with the thickness of straight layers found in conventional two-layer shafts. In general, the total thickness of the first straight layer (2) and second straight layer (4) is in the range of 0.2–0.4 mm. The respective thicknesses of the first and second straight layers can be set on the basis of the flexural rigidity, the flexural strength, and the like of the FRP shaft. It would be acceptable to have both layers formed with the same thickness.

In order to provide a light-weight shaft according to the objects of the invention, without changing the shaft characteristics and outer diameter, the thickness of the second angled layer (3) must be in the range of 0.04–0.10 mm. In addition, the reinforcing fibers of the second angled layer (3) must be oriented to form an angle in the range of 60–75 degrees relative to the longitudinal axis (L) of the shaft in order to maintain a crushing strength of 10 kg/mm.

The second angled layer (3) is constructed using a very thin prepreg (having a thickness of 0.05 mm or less) with a fiber weight of 18–55 g/m$^2$. In a preferred embodiment the fiber weight is in the range of 18–30 g/m$^2$. Commercially available prepreg materials can be used for easy implementation. Examples of commercially available materials include: HRX330M025S from Mitsubishi Rayon Corp. Ltd. (25 g/m$^2$ prepreg fabric density, 45% resin content, 0.025 mm thickness) and MR340K020S.

Prepreg

TABLE 1

| PRE-PREG | PRODUCT NAME | CARBON FIBER/ TENSILE ELASTICITY OF CARBON FIBERS | EPOXY RESIN | FIBER WEIGHT g/m$^2$ | RESIN CONTENT % by weight | THICKNESS mm |
|---|---|---|---|---|---|---|
| A | HRX370C125S | HR40/ 40 t/mm$^2$ | #370 | 116 | 25 | 0.095 |
| B | MR370C175S | MR30/ 30 t/mm$^2$ | #370 | 175 | 25 | 0.147 |
| C | MR340K020S | MR30/ 30 t/mm$^2$ | #340 | 23 | 40 | 0.025 |

TABLE 1-continued

| PRE-PREG | PRODUCT NAME | CARBON FIBER/ TENSILE ELASTICITY OF CARBON FIBERS | EPOXY RESIN | FIBER WEIGHT g/m$^2$ | RESIN CONTENT % by weight | THICKNESS mm |
|---|---|---|---|---|---|---|
| D | MR340J025S | MR30/ 30 t/mm$^2$ | #340 | 30 | 38.8 | 0.032 |
| E | TR340C125S | TR40/ 24 t/mm$^2$ | #340 | 125 | 25 | 0.104 |
| F | TR340E125S | TR40/ 24 t/mm$^2$ | #340 | 125 | 30 | 0.113 |
| G | HRX370C130S | HR40/ 40 t/mm$^2$ | #370 | 125 | 25 | 0.103 |

As shown in Table 1, various fiber materials have been investigated in order to demonstrate the present invention. The fiber angles referred to below are angles measured relative to the longitudinal orientation of the shaft. A detailed description of several preferred embodiments of the present invention follows.

Measuring Torsional Strength and Torsional Rigidity

Torsional tests are performed according to the golf club shaft certification standards and standards confirmation method as set forth by the Institute for Product Safety (approved by the Japanese Minister of International Trade and Industry, 5 Industry, Number 2087, Oct. 4, 1993).

Torsional strength of a shaft having a small-diameter end and a large-diameter end is measured as follows: the small-diameter end of the shaft is fixed in place; torque is applied to the large-diameter end. Using the 5KN universal tester from Mechatronics Engineering Corp. Ltd., the torsional strength is measured at the point when the shaft breaks due to torsional stress. Table 2 shows the results of this test on the various comparative examples and embodiments.

Measuring Flexural Strength

Figure 2:
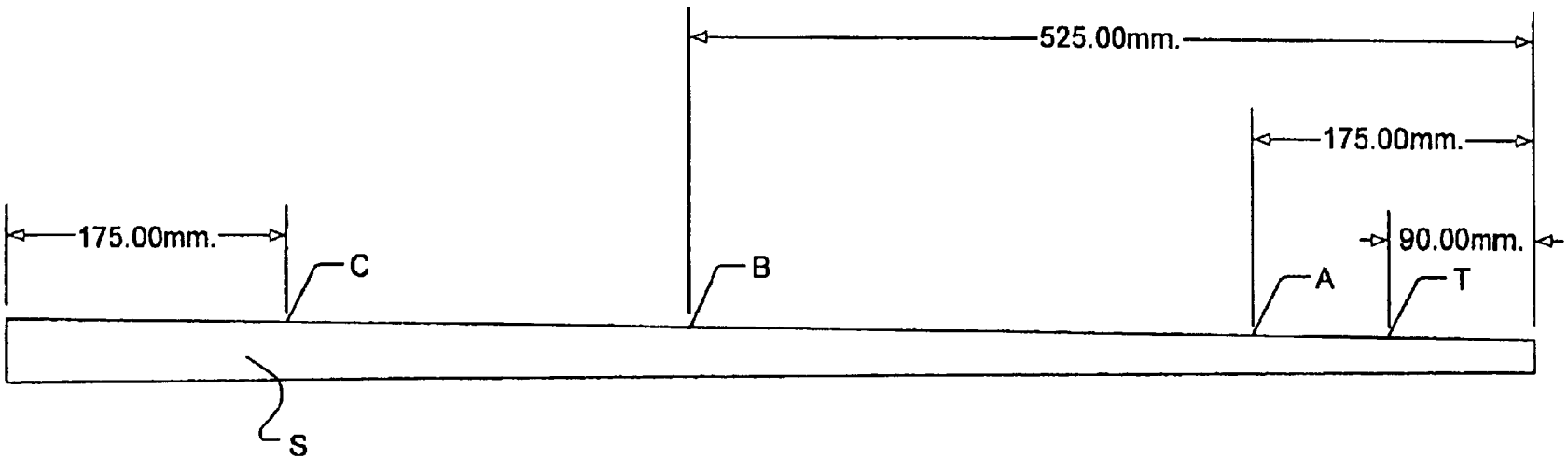
FIG. 2 shows various test points along the length of a shaft, used to characterize the present invention.

Referring to FIG. 2, a diagram indicates the location of various testing points for measuring flexural strength. A universal compression tester is used to carry out the test A point T (90 mm from the small-diameter end), a point A (175 mm from the small-diameter end), a point B (525 mm from the small-diameter end) and a point C (175 mm from the large-diameter end) on the shaft S are used to determine flexural strength. The test point is centered between two rounded iron supports having a radius of 12.5 mm. The supports have a span of 300 mm (150 mm for T only). A silicone rubber patch is set over the test point, which is the point where the compression tester penetrator contacts the shaft. The penetrator has a radius of 75 mm and is made of iron. The compression tester drives the penetrator into the shaft with a maximum load of 500 kg. The flexural strength is measured in terms of applied force and the displacement produced by the force. The shaft is also examined for defects such as cracks, and to confirm the structural integrity of the shaft. Table 2 below shows the results of the test.

Measuring Crushing Strength

Figure 3:
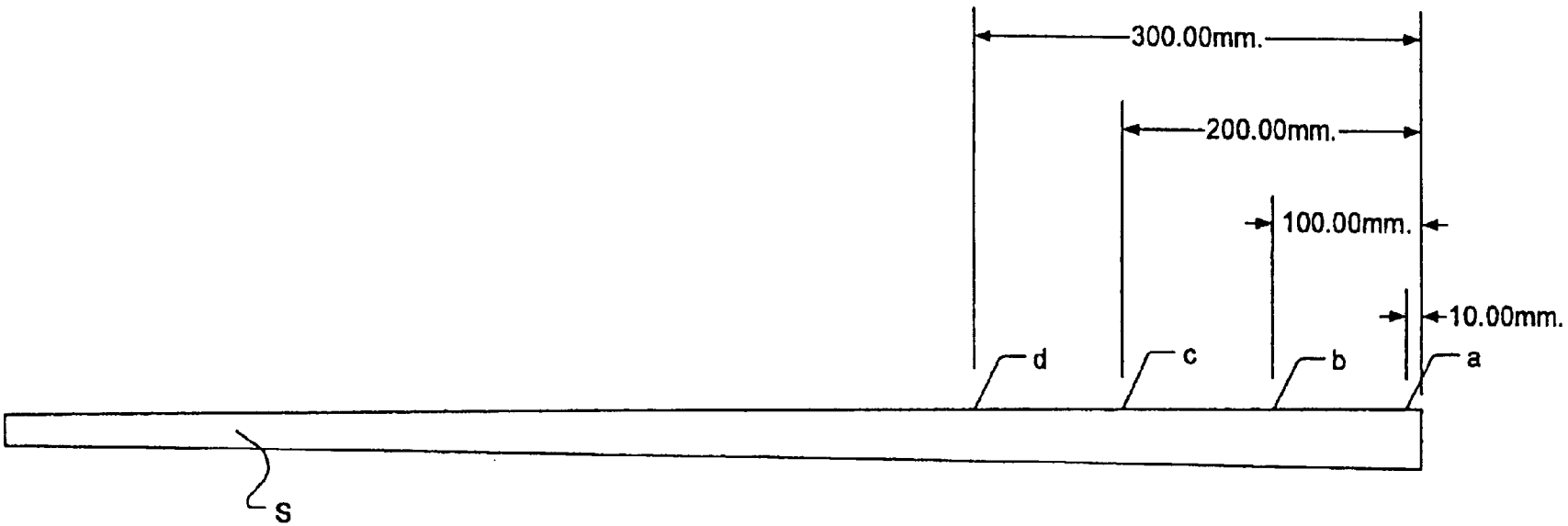
FIG. 3 shows various test points along the length of a shaft, used to characterize the present invention.
Figure 4A:
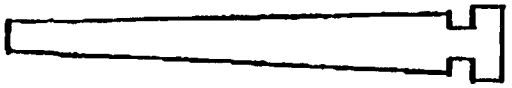
FIGS. 4(*a*)–4(*h*) show a mandrel and the shape and orientation of various layers according to an embodiment of the present invention.
Figure 4B:
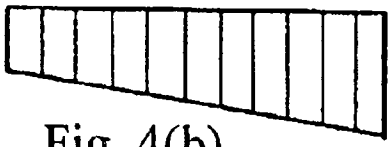
Figure 4C:
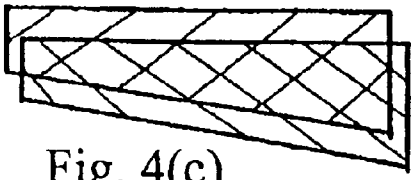
Figure 4D:
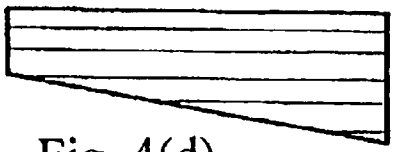
Figure 4E:
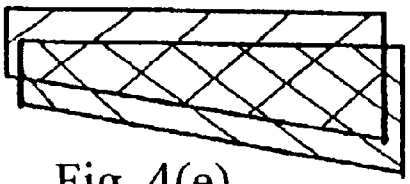
Figure 4F:
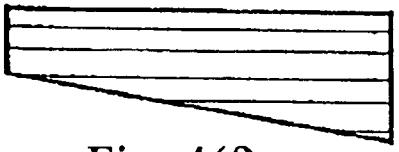
Figure 4G:
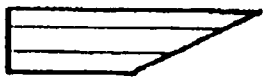
Figure 4H:
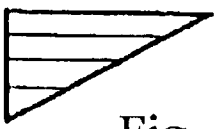

Referring now to FIG. 3, a diagram indicates the location of various test points used in measuring crushing strength. Sections of the shaft approximately 10 mm in length centered around the test point are used for test pieces. Crush strength tests are performed by compressing single sections of the shaft until deformation of the piece occurs. The test measures the force required to cause a deformation in the shaft section. Test pieces roughly 10 mm in length and centered at a point A (10 mm from the large-diameter end of the shaft), a point B (100 mm from the same), a point C (200 mm from the same), and a point D (300 mm from the same) are prepared and tested for strength. The test pieces are placed between two disk shaped iron plates which are moved toward each other while the force exerted is measured. The crushing strength is measured as the force exerted on the test pieces when deformation occurs. The results of the test are shown in Table 2 below.

Measuring Flexural Rigidity

Flexure is measured by stabilizing the large-diameter end of the shaft and applying a 1 kg load at a position 10 mm from the small-diameter end. The load causes a displacement of the small-diameter end of the shaft. The displacement is measured as the flexural rigidity. An upward oriented support for the large-diameter end of the shaft is located 920 mm from the small-diameter end. A downward oriented support for the large-diameter end is located 150 mm further from the small-diameter end, or 1070 mm total from the small-diameter end. The upward and downward support are effective to counter the 1 kg load to provide a consistent measurement technique for flexural rigidity. The results of this test are tabulated in Table 2.

Embodiment 1

A tapered metal mandrel having a tapered section, a straight section and a groove section, with the groove separating the tapered and straight sections is used as a forming mandrel. The mandrel is hardened in a hardening furnace while being held at the groove section. The tapered section of the mandrel has an outer diameter of 5.25 mm at the small-diameter end, an outer diameter of 14.05 mm at the large-diameter end and a length of 950 mm. The straight section of the mandrel has a diameter of 14.05 mm and a length of 550 mm. The groove has a smaller inner diameter that is less than that of the straight section of the mandrel. As described in steps (1)–(7) below, a series of layers are formed around the metal mandrel. The layers formed around this metal mandrel, in sequence, are as follows: a 90 degrees reinforcing layer, a first angled layer, a first straight layer, a second angled layer, a second straight layer, and an end-reinforcing layer.

Figure 5:
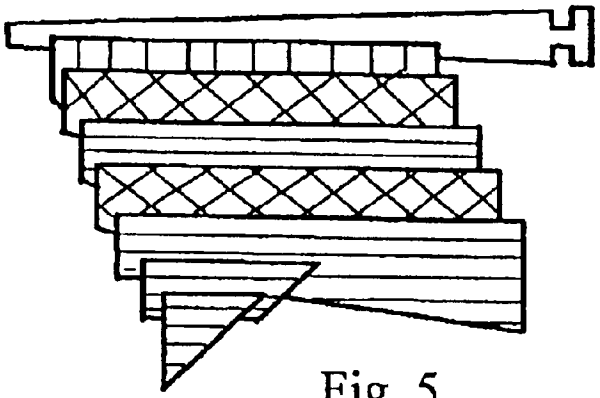
FIG. 5 shows a layer arrangement according to an embodiment of the present invention.

The steps in forming a shaft according to embodiment 1, as shown in FIGS. 4(*a*)–4(*h*) and FIG. 5, are described below.

(1) A prepreg is formed from a single layer of fiber material (prepreg D in Table I). The fibers contained therein are oriented at 90 degrees relative to the longitudinal axis of the shaft. The prepreg is sheared at the small-diameter end and the large-diameter end to result in a trapezoidal shaped material as in FIG. 4(*b*). The trapezoidal shaped material is then wrapped around a metal mandrel to form a 90 degrees reinforcing layer of the shaft.

(2) Two prepregs are each formed from single layers of fiber material (prepreg A in Table I). The fibers contained in the first prepreg are oriented at an angle of +45 degrees relative to the longitudinal axis of the shaft. The first prepreg is sheared at the small-diameter end and the large-diameter end resulting in a trapezoidal shape. The fibers contained in the second prepreg are oriented at an angle of −45 degrees relative to the longitudinal axis of the shaft. The second prepreg is sheared in same manner as the first prepreg. The two sheared prepregs are adhesively bonded together to form a single bonded material such that the fibers from the two sheared prepregs intersect as shown in FIG. 4(*c*). The single bonded material is then wrapped around the 90 degree reinforcing layer to form a first angled layer.

(3) A prepreg is formed from a single layer of fiber material (prepreg B in Table I). The fibers contained therein are oriented at an angle of 0 degrees relative to the longitudinal axis of the shaft. The prepreg is sheared so that a single layer is formed at the small-diameter end and the large-diameter end, resulting in a trapezoidal shape as shown in FIG. 4(*d*). The sheared prepreg is then wrapped around the first angled layer to form a first straight layer.

(4) Two prepregs are each formed from single layers of fiber material (prepreg C in Table I). The fibers contained in the first prepreg are oriented at an angle of +70 degrees relative to the longitudinal axis of the shaft. The first prepreg is sheared so that a single layer is formed at both the small-diameter end and the large-diameter end of the material, resulting in a trapezoidal shaped material. The second prepreg contains fibers that are oriented at an angle of −70 degrees relative to the longitudinal axis of the shaft. The second prepreg is sheared in the same manner as the first prepreg. The two sheared prepregs are adhesively bonded together to form a single bonded material, such that the fibers from the two sheared prepregs intersect as shown in FIG. 4(*e*). The single bonded material is then wrapped around the first straight layer to form a second angled layer.

(5) A prepreg is formed from a single layer of fiber material (prepreg E in Table I). The fibers contained therein are oriented at an angle of 0 degrees relative to the longitudinal axis of the shaft. The prepreg is sheared so that a single layer is formed at both the small-diameter end and the large-diameter end of the material, resulting in a trapezoidal shape as shown in FIG. 4(*f*). The sheared prepreg is then wrapped around the second angled layer to form a second straight layer.

(6) A prepreg is formed from a single layer of fiber material (prepreg E in Table I). The fibers contained therein are oriented at 0 degrees relative to the longitudinal axis of the shaft. The prepreg is sheared at the small-diameter end and at a position 300 mm from the small-diameter end to resist in a trapezoidal shaped material as shown in FIG. 4(*g*). The material is then wrapped around the second straight layer to form an end-reinforcing layer.

(7) A prepreg is formed from a single layer of fiber material (prepreg F in Table I). The fibers contained therein are oriented at 0 degrees relative to the longitudinal axis of the shaft. The prepreg is sheared in a roughly triangular shape so that the outer diameter of the small diameter end is 8.5 mm as shown in FIG. 4(*h*). This is then wrapped over the end-reinforcing layer to form an adjustment layer for adjusting the outer diameter of the small-diameter end.

A polypropylene tape having a width of 20 mm and a thickness of 30 microns is wrapped over these layers at a 2 mm pitch. The wrapped shaft is then hardened by placed it in a curing oven for 240 minutes at a temperature of 145° C.

After curing the materials, the polypropylene tape is removed. A flange attached to the groove in the metal mandrel is used to withdraw the metal mandrel. Both the small-diameter end and the large-diameter end have 10 mm of material cut off to form a shaft. The resulting shaft has a weight of 37 g, a length of 1145 mm, an outer diameter at the small-diameter end of 8.5 mm and an outer diameter at the large-diameter end of 15.0 mm. The resulting shaft has the characteristics shown in Table 2.

Comparative Example 1

For comparison, another shaft was designed similar to embodiment 1. The steps involved in forming the shaft, according to comparative example 1, follows below.

(1) A 90-degree reinforcing layer is formed as in step 1 of embodiment 1 discussed above (prepreg D in Table I).

(2) A first angled layer is formed as in step 2 of embodiment 1 discussed above (prepreg A in Table I).

(3) A first straight layer is formed as in step 3 of embodiment 1 discussed above (prepreg B in Table I).

(4) Two prepregs are each formed from single layers of fiber material (prepreg C in Table I). The fibers contained in the first prepreg are oriented at an angle of +20 degrees relative to the longitudinal axis of the shaft. The fist prepreg is sheared so that a single layer is formed at both the small-diameter end and the large-diameter end of the material. The second prepreg contains fibers that are oriented at an angle of −20 degrees relative to the longitudinal axis of the shaft. The second prepreg is sheared in same manner as the first prepreg. The two sheared prepregs are adhesively bonded together to form a single bonded material, such that the fibers from the two sheared prepregs intersect. The single bonded material is then wrapped around the first straight layer to form the second angled layer.

(5) A second straight layer is formed as in step 5 of embodiment 1 discussed above (prepreg E in Table I).

(6) An end-reinforcing layer is formed as in step 6 of embodiment 1 discussed above (prepreg E in Table I).

(7) A layer is formed for adjusting the diameter of the small-diameter end, as in step is 7 of embodiment 1 discussed above (prepreg F in Table I).

The above formed shaft is hardened as described in embodiment 1 to form a shaft weighing 37 g, having a length of 1145 mm, an outer diameter of 8.5 mm at the small-diameter end, and an outer diameter of 15.0 mm at the large-diameter end. The resulting shaft has the characteristics shown in Table 2.

Comparative Example 2

A shaft is formed in the same manner as in embodiment 1 except that the second angled layer (C) is eliminated, and the number of layers of prepregs A, which have fiber orientations of +45 degrees and −45 degrees, is 2.1 at the small-diameter end and 1.1 at the large-diameter end. The resulting shaft weighs 37 g and has a length of 1145 mm, an outer diameter of 8.5 mm at the small-diameter end, and an outer diameter of 15.0 mm at the large-diameter end. The resulting shaft has the characteristics shown in Table 2.

Characteristics of shafts made according to embodiment 1, comparative example 1 and comparative example 2 are shown in Table 2 below.

TABLE 2

| | FLEXURAL RIGIDITY mm | FLEXURAL STRENGTH kgf | CRUSHING STRENGTH kg/10 mm | TORSIONAL STRENGTH kgf · m · degrees (N · m · degrees) |
|---|---|---|---|---|
| Embodiment 1 | 70 | T:120<br>A:60<br>B:55<br>C:55 | a:11.0<br>b:11.0<br>c:11.0<br>d:12.0 | 150<br>(1500) |
| Comparitive Example 1 | 70 | T:120<br>A:60<br>B:40<br>C:40 | a:5.1<br>b:5.3<br>c:5.0<br>d:5.5 | 120<br>(1200) |
| Comparitive Example 2 | 70 | T:100<br>A:50<br>B:35<br>C:35 | a:4.9<br>b:5.0<br>c:5.2<br>d:5.6 | 100<br>(1000) |

Embodiments 2–5 and Comparative Examples 3–4

Embodiments 2–5 and comparative examples 3–4 utilize the same steps to form the shaft as found in embodiment 1 discussed above, with a slight variation on the first angled layer and the second angled layer.

In embodiments 2–4 and comparative examples 3–4, the prepreg used to form the first angled layer is changed from prepreg A to prepreg G (see Table I). The second angled layer is formed from prepreg C. Each angled layer is formed by adhesively bonding two prepregs together as in step 4 of embodiment 1. The fiber orientation of the two prepregs used in each embodiment is described below.

In embodiment 2, the second angled layer is replaced with an angled layer consisting of two prepreg layers which are oriented at angles of +/−45 degrees respectively.

In embodiment 3, the second angled layer is replaced with an angled layer consisting of two prepreg layers which are at angles of +/−60 degrees respectively.

In embodiment 4, the second angled layer is replaced with an angled layer consisting of two prepreg layers which are at angles of +/−70 degrees respectively.

In embodiment 5, the second angled layer is replaced with an angled layer consisting of two prepreg layers which are at angles of +/−75 degrees respectively.

In comparative example 3, the second angled layer is replaced with an angled layer consisting of two prepreg layers which are at angles of +/−20 degrees respectively.

In comparative example 4, the second angled layer is replaced with an angled layer consisting of two prepreg layers which are at angles of +/−80 degrees respectively.

The resulting shafts from embodiments 2–5 and comparative examples 3–4 each weigh 38 g, have lengths of 1145 mm, outer diameters of 8.5 mm at the small-diameter ends, and outer diameters of 15.0 mm at the large-diameter ends.

The above formed shafts were hardened as described in embodiment 1 to form shafts weighing 37 g, each having a length of 1145 mm, each having an outer diameter of 8.5 mm at the small-diameter end, and each having an outer diameter of 15.0 mm at the large-diameter end. The resulting shafts have the characteristics shown in Table 3 below.

TABLE 3

| | FLEXURAL RIGIDITY mm | FLEXURAL STRENGTH kgf | CRUSHING STRENGTH kg/10 mm | TORSIONAL STRENGTH kgf · m · degrees (N · m · degrees) |
|---|---|---|---|---|
| Comparative Example 3 | 68 | T:—<br>A:63<br>B:41<br>C:39 | a:5.8<br>b:6.0<br>c:5.6<br>d:6.1 | 157<br>(1570) |
| Embodiment 2 | 69 | T:—<br>A:61<br>B:48<br>C:43 | a:8.5<br>b:8.4<br>c:8.5<br>d:7.8 | 160<br>(1600) |
| Embodiment 3 | 70 | T:—<br>A:62<br>B:50<br>C:46 | a:8.8<br>b:9.2<br>c:9.5<br>d:9.6 | 179<br>(1790) |
| Embodiment 4 | 70 | T:—<br>A:62<br>B:52<br>C:52 | a:11.0<br>b:11.0<br>c:11.0<br>d:12.0 | 150<br>(1500) |
| Embodiment 5 | 70 | T:—<br>A:65<br>B:52<br>C:50 | a:12.2<br>b:10.9<br>c:10.3<br>d:12.1 | 157<br>(1570) |
| Comparative Example 4 | 70 | T:—<br>A:62.3<br>B:51<br>C:54 | a:10.6<br>b:11.6<br>c:11.4<br>d:11.8 | 159<br>(1590) |

Comparison of embodiments 1–5 and comparative examples 1–4 show that the shafts constructed according to the present invention achieve the objects of the invention. The weight of the shaft is reduced without a loss of shaft diameter or diminished structural strength characteristics.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for forming a golf club shaft around a mandrel having a length along a longitudinal axis, the steps comprising:

forming a first reinforcement layer from a first fiber material, said first fiber material having fibers aligned along a single direction and said fibers only extending alone an entire length of said first reinforcement layer;

forming a first angled layer by bonding second and third fiber materials, such that the fibers of said second material form a first angle with the fibers of said third material, said second and third materials having fibers aligned along a single direction and said second and said third fibers only extending along an entire length of said first angled layer;

forming a first straight layer from a fourth fiber material, said fourth fiber material having fibers aligned along a single direction and said fibers only extending along an entire length of said first straight layer;

forming a second angled layer from fifth and sixth fiber material, said fifth and sixth materials having fibers aligned along a single direction and said fifth and said sixth fibers only extending along an entire length of said second angled layer;

bonding said fifth and sixth fiber materials together to form said second angled layer, such that said fibers of said fifth and sixth material form a second angle in the range of from 70–150 degrees and said second angled layer has a thickness in the range of from 0.04 to 0.1 mm;

forming a second straight layer from a seventh fiber material, said seventh fiber material having fibers aligned along a single direction and said fibers only extending along an entire length of said second straight layer;

forming a second reinforcement layer from an eighth fiber material, said fiber material having fibers aligned along a single direction and said fibers only extending along an entire length of said second reinforcement layer;

wrapping said first reinforcement layer around said mandrel such that said fibers of said first reinforcement layer are aligned 90 degrees with respect to said longitudinal axis;

wrapping said first angled layer around said first reinforcement layer such that said first angle of said fiber material of said first angled layer is bisected by said longitudinal axis;

wrapping said first straight layer around said first angled layer such that said fibers of said first straight layer are aligned with said longitudinal axis;

wrapping said second angled layer around said first straight layer such that said second angle of said fiber material of said second angled layer is bisected by said longitudinal axis;

wrapping said second straight layer around said second angled layer such that said fibers of said second straight layer are aligned with said longitudinal axis;

wrapping second reinforcement layer around said second straight layer to form a layered wrap, such that said fibers of said second reinforcement layer are aligned with said longitudinal axis;

curing said layered wrap in an oven to form a cured shaft;

removing said mandrel from said cured shaft; and trimming ends said cured shaft to produce said golf club shaft having a weight of 30 to 40 grams.

2. A method for forming a golf club shaft around a mandrel having a length along a longitudinal axis, the steps consisting of:

forming a first reinforcement layer from a first fiber material, said first fiber material having fibers aligned along a single direction and said fibers only extending along an entire length of said first reinforcement layer;

forming a first angled layer by bonding second and third fiber materials, such that the fibers of said second material form a first angle with the fibers of said third material, said second and third materials having fibers aligned along a single direction and said second and said third fibers only extending along an entire length of said first angled layer;

forming a first straight layer from a fourth fiber material, said fourth fiber material having fibers aligned along a single direction and said fibers only extending along an entire length of said first straight layer;

forming a second angled layer from fifth and sixth fiber material, said fifth and sixth materials having fibers aligned along a single direction and said fifth and said sixth fibers only extending along an entire length of said second angled layer;

bonding said fifth and sixth fiber materials together to form said second angled layer, such that said fibers of said fifth and sixth material form a second angle in the range of from 70–150 degrees and said second angled layer has a thickness in the range of from 0.04 to 0.1 mm;

forming a second straight layer from a seventh fiber material, said seventh fiber material having fibers aligned along a single direction and said fibers only extending along an entire length of said second straight layer;

forming a second reinforcement layer from an eighth fiber material, said fiber material having fibers aligned along a single direction and said fibers only extending along an entire length of said second reinforcement layer;

wrapping said first reinforcement layer around said mandrel such that said fibers of said first reinforcement layer are aligned 90 degrees with respect to said longitudinal axis;

wrapping said first angled layer around said first reinforcement layer such that said first angle of said fiber material of said first angled layer is bisected by said longitudinal axis;

wrapping said first straight layer around said first angled layer such that said fibers of said first straight layer are aligned with said longitudinal axis;

wrapping said second angled layer around said first straight layer such that said second angle of said fiber material of said second angled layer is bisected by said longitudinal axis;

wrapping said second straight layer around said second angled layer such that said fibers of said second straight layer are aligned with said longitudinal axis;

wrapping second reinforcement layer around said second straight layer to form a layered wrap, such that said fibers of said second reinforcement layer are aligned with said longitudinal axis;

curing said layered wrap in an oven to form a cured shaft;

removing said mandrel from said cured shaft; and trimming ends said cured shaft to produce said golf club shaft.

3. A method for forming a golf club shaft around a mandrel having a length along a longitudinal axis, the steps comprising:

forming a first reinforcement layer from a first fiber material, said first fiber material having fibers aligned along a single direction and said fibers only extending along an entire length of said first reinforcement layer;

forming a first angled layer by bonding second and third fiber materials, such that the fibers of said second material form a first angle with the fibers of said third material, said second and third materials having fibers aligned along a single direction and said second and said third fibers only extending along an entire length of said first angled layer;

forming a first straight layer from a fourth fiber material, said fourth fiber material having fibers aligned along a single direction and said fibers only extending along an entire length of said first straight layer;

forming a second angled layer from fifth and sixth fiber material, said fifth and sixth materials having fibers aligned along a single direction and said fifth and said sixth fibers only extending along an entire length of said second angled layer;

bonding said fifth and sixth fiber materials together to form said second angled layer, such that said fibers of said fifth and sixth material form a second angle in the range of from 70–150 degrees and said second angled layer has a thickness in the range of from 0.04 to 0.1 mm;

forming a second straight layer from a seventh fiber material, said seventh fiber material having fibers aligned along a single direction and said fibers only extending along an entire length of said second straight layer;

forming a second reinforcement layer from an eighth fiber material, said fiber material having fibers aligned along a single direction and said fibers only extending along an entire length of said second reinforcement layer;

wrapping said first reinforcement layer around said mandrel such that said fibers of said first reinforcement layer are aligned 90 degrees with respect to said longitudinal axis;

wrapping said first angled layer directly around said first reinforcement layer such that said first angle of said fiber material of said first angled layer is bisected by said longitudinal axis;

wrapping said first straight layer directly around said first angled layer such that said fibers of said first straight layer are aligned with said longitudinal axis;

wrapping said second angled layer directly around said first straight layer such that said second angle of said fiber material of said second angled layer is bisected by said longitudinal axis;

wrapping said second straight layer directly around said second angled layer such that said fibers of said second straight layer are aligned with said longitudinal axis;

wrapping second reinforcement layer directly around said second straight layer to form a layered wrap, such that said fibers of said second reinforcement layer are aligned with said longitudinal axis;

curing said layered wrap in an oven to form a cured shaft;

removing said mandrel from said cured shaft; and trimming ends said cured shaft to produce said golf club shaft.

* * * * *